United States Patent [19]

Davis et al.

[11] 4,261,532

[45] Apr. 14, 1981

[54] BOBBIN CARRIER

[75] Inventors: Robert E. Davis; James U. Burcham, both of Winston-Salem; Kenneth E. Smith, Rural Hall, all of N.C.

[73] Assignee: Hanes Corporation, Winston-Salem, N.C.

[21] Appl. No.: 83,462

[22] Filed: Oct. 10, 1979

[51] Int. Cl.[3] ..... B65H 49/02; D02H 1/00

[52] U.S. Cl. ..... 242/131

[58] Field of Search ..... 242/131, 131.1, 130; 28/32; 66/125 R, 161, 163

[56] References Cited

U.S. PATENT DOCUMENTS

| | | | |
|---|---|---|---|
| 3,589,146 | 6/1971 | Schmidt | 66/125 |
| 3,674,223 | 7/1972 | Philip | 242/131 |
| 4,023,747 | 5/1977 | Champagne | 242/130 |

*Primary Examiner*—Leonard D. Christian

*Attorney, Agent, or Firm*—Charles Y. Lackey; William S. Burden

[57] ABSTRACT

A bobbin carrier includes a rectangular frame having adjustable support shafts mounted at the corners thereof which, in turn, individually adjustably support brackets, each of which includes means for adjustably and slidably positioning thereon a pair of support rods adapted to receive large yarn bobbins. Yarn bobbins supported upon the carrier are selectively aligned, and spaced uniform distances from generally centrally located first guide means resulting in uniformity of feed of yarns to a machine which utilizes the yarns. Bobbins may be replaced by slidably retracting the support rods relative to the bobbin and the brackets.

11 Claims, 10 Drawing Figures

BOBBIN CARRIER

BACKGROUND, BRIEF SUMMARY AND OBJECTS OF THE INVENTION

This invention relates generally to creels or bobbin carriers for supporting a plurality of yarn packages.

There are many types of creels for supporting yarn packages in different configurations for supplying yarns to various machines, for example, as disclosed by U.S. Pat. Nos. 3,596,851 and 1,833,591. In many conventional creels, uniformity of yarn feed varies due to misalignment of the yarn bobbins, unequal spacing of the bobbins from a machine utilizing the yarns, variable ballooning of the yarns, numerous and variable changes in yarn direction, etc.

The present invention is directed to a new and improved creel particularly adapted for use with circular knitting machines. The creel permits the use of large yarn packages which are adjustably positioned substantially equidistant from a knitting machine cylinder centerline, thus facilitating uniformity of yarn feed. The apparatus includes a square or rectangular frame which has vertically disposed, adjustable support shafts at the corners thereof. A series of horizontally extending brackets, each adapted to support at least one pair of yarn bobbin support rods, are adjustably mounted upon the support shafts. Each pair of bobbin support rods is adapted to support a first bobbin from which yarn is being fed to a knitting machine, and a full, standby second yarn bobbin. The tail end of the yarn on the feeding bobbin is tied to the leading end of the full bobbin, in a conventional manner, to avoid interruption in yarn feed during operation of the machine. The yarn bobbin support rods are adjustably mounted relative to their respective support brackets to accommodate yarn packages of various sizes and to permit alignment of the bobbins toward a common guide and the center line of the knitting machine cylinder. A series of vertically spaced and adjustably positioned guide members, each having a plurality of yarn guide eyelets, are generally centrally located with respect to the square frame and aligned with a knitting machine cylinder.

Positioning of the yarn bobbins adjacent to the corners of the frame and above the knitting machine provides efficient utilization of floor space. This invention permits the use of yarn bobbins of large diameter and extended length since they are supported adjacent the corners of the frame and since bobbins can be removed from the creel or mounted upon the creel by readily slideably retracting the bobbin support rods, relative to the support brackets, to out-of-the-way positions, rather than displacing the bobbins and holders axially of the support rods, when replacement is necessary.

The generally horizontally disposed yarn bobbins are selectively aligned in desired positions by vertical and/or angular adjustment of the support shafts, adjustment of the brackets vertically and/or horizontally, and selective positioning of the bobbin support rods relative to the brackets.

One of the primary objects of the invention is the provision of a new and improved yarn creel.

Another object of the invention is the provision of a yarn creel having means for adjustably aligning and fixedly positioning yarn bobbins at selected locations.

Still another object of the invention is the provision of a yarn creel capable of locating and aligning yarn bobbins of various sizes in the most advantageous positions and for guiding the yarns to a yarn manufacturing operation with minimum changes in yarn direction.

A further object of the invention is the provision of a creel which efficiently utilizes floor space, and permits the use of longer yarn packages of large diameter by supporting the packages upon readily displaceable support rods.

Other objects and advantages of the invention will become apparent when considered in view of the following detailed description.

DETAILED DESCRIPTION OF THE INVENTION

Figure 1:
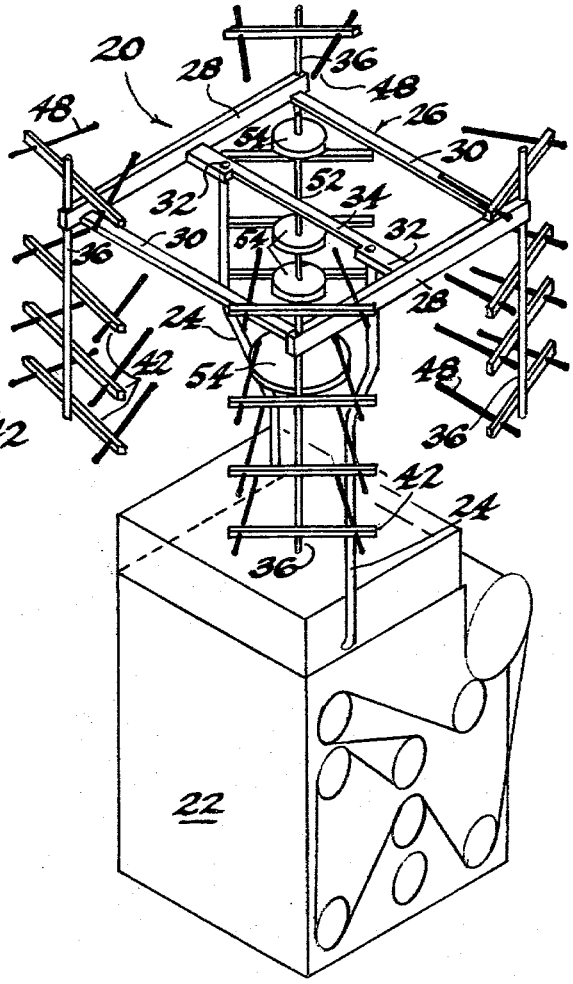
FIG. 1 is a schematic, perspective view of one embodiment of the yarn carrier of the present invention.

Referring to the drawing, and particularly to FIG. 1, the bobbin carrier 20 is shown mounted upon a conventional circular knitting machine 22 in a manner to guide yarns with minimum change of direction from large yarn packages positioned substantially equal distances from and generally aligned with the centerline of the cylinder of a knitting machine.

The carrier 26 includes a pair of vertically disposed uprights 24, 24 supporting a frame 26 above the machine 22. In the embodiment illustrated by FIG. 1, the uprights 24, 24 are mounted upon the machine 22 by suitable fasteners, not shown. However, it is to be understood that the uprights 24, 24 could support the carrier 20 from the floor or other base structure independent of the machine 22.

The frame 26 in the illustrated embodiment is generally rectangular comprising pairs of parallel, interconnected members 28, 28 and 30, 30 which may be of tubular construction. The members, 28, 28 and 30, 30 may be secured together by welding or other suitable means. A bracket 32 is secure to each member 28 approximately midway of the length, and the brackets extend inwardly for attachment to the uprights 24, 24. A cross member 34 interconnects the brackets 32, 32.

Figure 2:
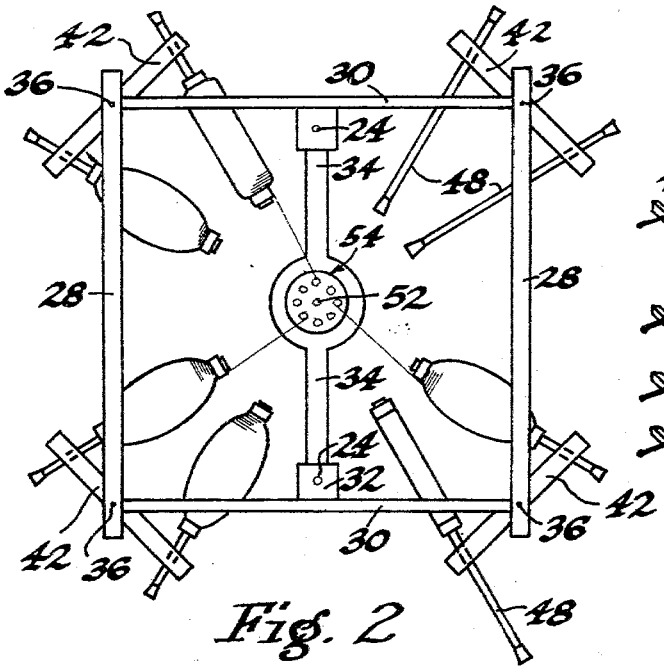
FIG. 2 is a schematic, top plan view of the rectangular frame illustrating the positioning of the yarn bobbins thereon.

A vertically extending support shaft 36 is positioned at each corner of the rectangular frame 26, as shown by FIGS. 1 and 2. In the embodiment of FIGS. 1–8, the members 28, 28 are formed of rectangular tubing having openings adjacent each end for slideably and rotatably receiving the support shafts 36. The shafts 36 may be vertically and rotatably adjustably positioned within the openings of tubular members 28 and releasably secured by a set screw, not shown, passing through a side wall of a tubular member 28, or by collars 38 and set screws 40, FIGS. 6, secured on one or both sides of the tubular members 28. The collars 38 may be fixedly secured to the tubular members 28.

Each support shaft 36 carries one or more horizontally disposed brackets 42 formed of tubular stock material. A bushing 46 is welded to each bracket 42 for receiving a support shaft 36, and a pair of set screws 44 fasten the bushing 46 and bracket 42 to the shaft 36. The set screws are tightened after adjusting the bracket 42 vertically and angularly relative to the shaft 36 to a selected position. In the embodiment illustrated, four brackets 42 are selectively positioned by set screws 44 upon each shaft 36.

Figure 5:
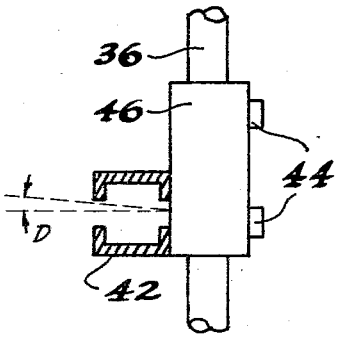
FIG. 5 is an end elevational view, partly in section, of the apparatus of FIG. 4.
Figure 3:
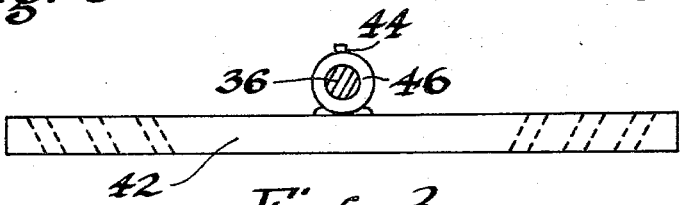
FIG. 3 is a schematic, enlarged, top plan view of a bracket mounted upon a support shaft.
Figure 4:
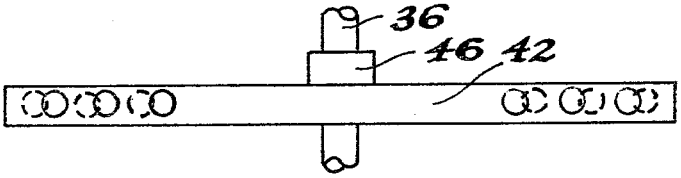
FIG. 4 is a front elevational view of the apparatus of FIG. 3.
Figure 7:
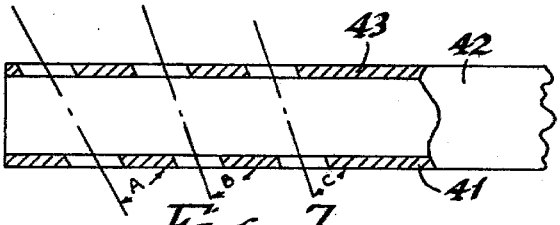
FIG. 7 is an enlarged, top plan view, partly in section, of an end portion of a bracket.

As shown most clearly by FIGS. 3–5 and 7, the front 41 and rear 43 walls of each tubular bracket 43 are provided with openings for receiving yarn package support rods 48. Each rod is cylindrical and has a plastic tip 50 attached to each end. Referring particularly to FIGS. 3, 4 and 7, each end portion of each of the brackets 42 is provided with three openings drilled therein, a first opening having an axis extending at an angle A of approximately 67.5 degrees relative to the elongated bracket, a second opening having an angle B of approximately 70 degrees, and a third opening having an angle C of approximately 72.5 degrees. However, the openings may be drilled at various selected angles depending upon yarn package sizes, etc. The diameters of the openings are slightly greater than the diameter of the support rods permitting the rods to be freely slidably displaced relative to the brackets. Also, it is to be noted that the openings are inclined upwardly at an angle D, which may be approximately 6 degrees with respect to the horizontal, as shown by FIG. 5. Normally, one support rod 48 is positioned within a selected bracket opening on each side of a support shaft 36, as shown by FIGS. 1 and 2, with a substantial portion of the length of each support rod 48 extending inwardly of the brackets 42 and frame 26 and inclined upwardly at a small angle. The plastic tips 50 prevent inadvertent removal of the rods from the brackets 42. When a yarn package or bobbin is placed over a rod 48, the package or bobbin weight acting on the rod tends to lock the rod in position due to the frictional engagement of the rod with the front and rear walls 41, 43. Yarn packages may be positioned on selected support rods 48, as required, depending upon the number and type of yarns utilized in forming the fabric.

Positioning the yarn package support shafts 36 and brackets 42 at the corners of frame 26 results in efficient utilization of floor space as well as permitting the use of larger diameter and longer length yarn packages. The packages are generally horizontally disposed and extend toward the center line of the knitting machine cylinder. It is to be noted that the yarn package carrier of the present invention positions all packages approximately the same distance from the machine center line. All packages upon a support shaft 36 may be angularly adjusted to desired positions by means of the set screws 40 and the collars 38. The brackets 42 may be independently adjustably positioned relative to the support shaft 36 by set screws 44, and the angle of each support rod 48 may be varied by inserting the rod in a selected one of the plural openings provided through the bracket 42 and different angles.

Figure 8:
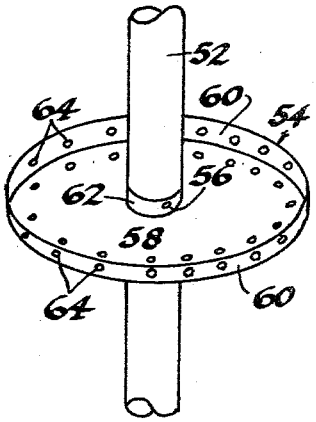
FIG. 8 is a schematic, enlarged view of a yarn guide member.

A vertically disposed shaft 52 is attached to the cross member 34, intermediate the ends thereof, for supporting a plurality of guide members 54 axially spaced along the shaft and axially aligned with the cylinder of the knitting machine. The guide members 54 are adjustably secured along the shaft 52 by set screws 56 for proper horizontal alignment with the yarn packages supported upon the rods 48. As shown by FIG. 8, each guide member includes a disk portion 58, a peripheral flange 60, and the hub portion 62 for receiving the shaft 52. Each of the portions 58 and 60 has a series of openings having guide eyelets 64 formed of ceramic or other suitable materials. As shown by FIG. 2, yarns withdrawn for the packages generally axially of the package bobbin or support and is directed generally horizontally towards a guide member 54 where it is guided first through an eyelet 64 and the flange 60 and then vertically downwardly through an eyelet 64 and the disk portion 58 where it is aligned with an outer peripheral portion of the machine cylinder.

In the present invention all yarn bobbins are positioned a substantially uniform distance from the guide members 54 and each package bobbin is actually directed generally horizontally toward the center line of the machine cylinder. The yarns also are directed to the knitting cylinder with a minimum number of changes of yarn direction as they are fed to the machine.

Figure 9:
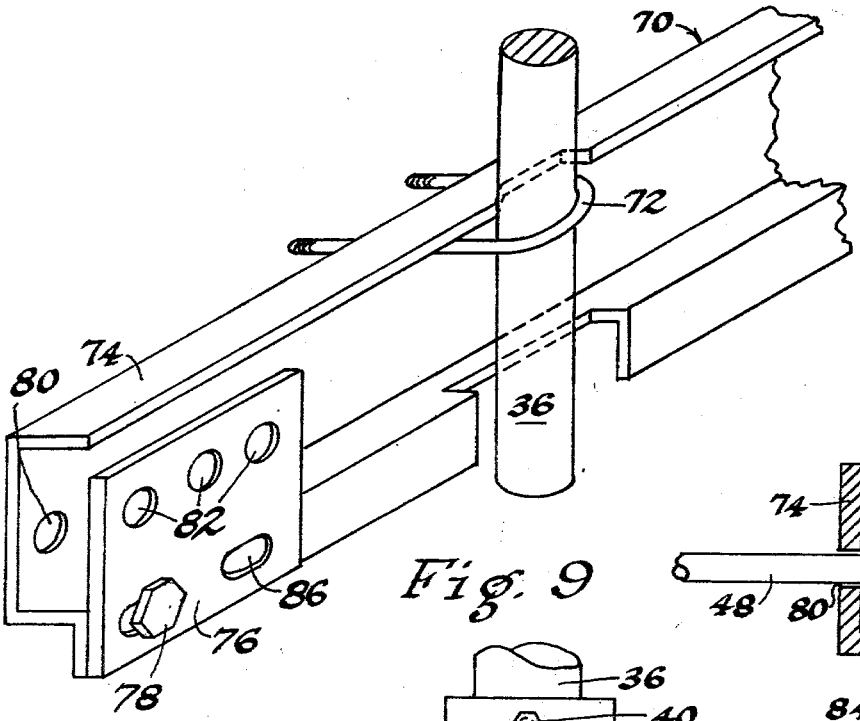
FIG. 9 is a fragmentary, perspective view of a modified embodiment of a support rod bracket mounted upon a support shaft.
Figure 10:
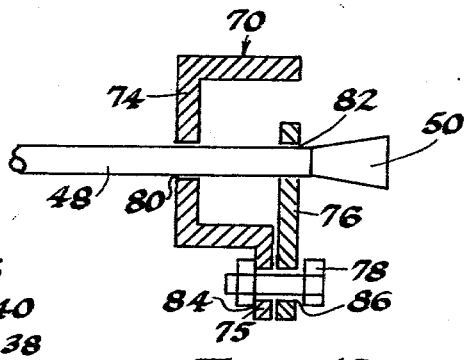
FIG. 10 is a sectional view of the bracket of FIG. 9 and illustrating the positioning of a bobbin support rod therein.
Figure 6:
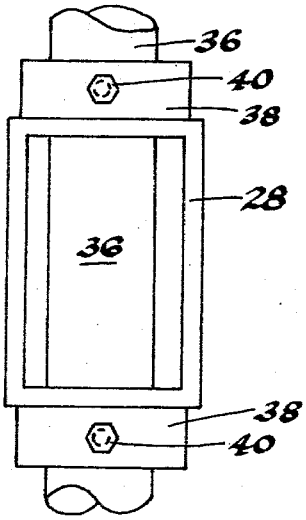
FIG. 6 is a schematic, enlarged view of means for securing the support shafts upon the rectangular frame.

FIGS. 9 and 10 illustrate another apparatus for adjustably mounting the support rods 58 to align the packages supported thereon with a line passing axially of the machine cylinder.

The bobbin support rods 48 may be adjustably positioned for proper package alignment by means of the support structure illustrated by FIGS. 9 and 10. Rather than utilizing the tubular brackets 42 having a plurality of angled openings therein, the rods 48 may be supported by brackets 70 which are adjustably, fixedly positioned upon the support shafts 36 by suitable fasteners 72. Each bracket 70 includes a U-shaped angle member 74 having a length generally corresponding to the length of brackets 42, a flange 75 integral with member 74, and plates 76 are adjustably secured to the ends of flange 75 by suitable fasteners 78.

A plurality of openings 80, each having a diameter sufficiently large to slideably receive a support rod 48, are provided in the U-shaped member 74. A plurality of openings 82, adapted to be generally aligned with openings 80, are provided in each of the plates 76. The flange 75 is provided with openings 84, FIG. 10, and the plates are provided with elongated openings 86 for receiving fasteners 78.

A support rod 48 normally extends through a generally aligned pair of openings 80 and 82 in the members 74 and 75, respectively, and that portion of the rod projecting from bracket 70 may be selectedly positioned by shifting the plate 76 horizontally and/or vertically relative to flange 75 and fastener 78 tightened to secure the rod in a desired position.

As with the bracket 42 of FIGS. 1–8, the rod 48, having a bobbin or package positioned thereon is urged into frictional engagement with members 74 and 75 to prevent sliding of the rod relative to the bracket 70.

When it is necessary to provide an elongated or large diameter yarn package upon a support rod 48, an operator grasps the rod and/or cap 50 to slide the rod away from the guide members 54, thus withdrawing the rod from a package or bobbin or support. A new yarn package is properly positioned by an operator and the rod 48 is inserted with the package support or bobbin.

What is claimed is:

1. A bobbin carrier for a circular knitting machine comprising, frame means including a plurality of members defining a unit overlying a knitting machine, vertically disposed support means, means adjustably positioning said support means upon said frame means, bracket means mounted upon said vertically disposed support means, means releasably securing said bracket means in selected positions of vertical adjustment along said vertically disposed support means, yarn bobbin support means, said bracket means including means for supporting said yarn bobbin support means in selected positions relative to said bracket means, said bracket means including a plurality of horizontally extending brackets, and said vertically disposed support means including a plurality of elongated, spaced members, each disposed in a vertical plane and supported upon said frame means, each of said plurality of vertically disposed members supporting a plurality of horizontally extending, vertically spaced brackets.

2. A bobbin carrier as recited in claim 1, wherein said yarn bobbin support means includes a plurality of elongated rods, and wherein each said bracket supports a plurality of rods thereon.

3. A bobbin carrier as recited in claim 1, wherein said bobbin support means includes a plurality of elongated rods, and in wherein each bracket is provided with means for permitting an elongated rod to be selectively positioned relative to the bracket.

4. A bobbin carrier as recited in claim 3, wherein each bracket is provided with a plurality of discrete openings extending therethrough at various selected angles relative to each other for selectively receiving an elongated rod therein.

5. A bobbin carrier as recited in claim 4, wherein the elongated rods are slidably received within selected openings to facilitate displacement of the rods relative to said brackets for facilitating positioning of full yarn bobbins upon and removal of empty bobbins from the bobbin carrier.

6. A bobbin carrier as recited in claim 2, wherein each said bracket includes an elongated member having a first opening therethrough, and a plate having a second opening therein, said first and second openings slidably receiving therein one of said plurality of elongated rods, and means for adjustably positioning said plate relative to said elongated bracket member first opening to selectively vary the position of said one elongated rod relative to the bracket.

7. A bobbin carrier as recited in claim 1, wherein said plurality of horizontally disposed members defines a generally rectangular unit, said vertically disposed members being positioned adjacent each corner of said rectangular unit, and further including yarn guide means supported by said frame means for directing yarns from bobbins mounted upon said yarn bobbin support means to a knitting machine.

8. A bobbin carrier as recited in claim 7 wherein said yarn guide means is substantially equally spaced from said vertical members positioned at the corners of said rectangular unit.

9. A bobbin carrier as recited in claim 8, wherein said yarn guide means includes a plurality of discrete guide members positioned in vertical spaced relation, and wherein said yarn bobbins support means includes a plurality of elongated support rods supported by said brackets, the longitudinal axis of said support rods being directed towards a discrete guide member for directing yarns with minimum change of direction to a knitting machine.

10. A bobbin carrier as recited in claim 9, wherein said discrete guide members in vertical spaced relation are generally vertically aligned above and centrally positioned relative to a knitting machine cylinder, each said discrete guide members including a series of yarn guide eyelets.

11. A yarn bobbin support for creels comprising; an elongated, generally horizontally disposed rod for receiving a yarn bobbin thereon, a bracket including means for slidably supporting said rod at various selected positions of adjustment relative to said bracket, a vertically disposed support member, means adjustably mounting said bracket upon said support member for vertical and angular adjustment relative to said support member, a frame unit, means supporting and selectively positioning said support member upon said frame unit and means for positioning said frame unit in vertically spaced overlying relation above a support surface.

* * * * *